US008601916B2

(12) United States Patent
Chen

(10) Patent No.: US 8,601,916 B2
(45) Date of Patent: Dec. 10, 2013

(54) MULTIFUNCTIONAL HAND TOOL

(76) Inventor: Chieh-Lung Chen, Taichung (TW)

( * ) Notice: Subject to any disclaimer, the term of this patent is extended or adjusted under 35 U.S.C. 154(b) by 248 days.

(21) Appl. No.: 13/251,564

(22) Filed: Oct. 3, 2011

(65) Prior Publication Data

US 2013/0081210 A1 Apr. 4, 2013

(51) Int. Cl.

| | |
|---|---|
| ***B25F 1/02*** | (2006.01) |
| ***B25G 1/00*** | (2006.01) |
| ***B25D 1/00*** | (2006.01) |

(52) U.S. Cl.

USPC ..... 81/439; 81/20; 7/143

(58) Field of Classification Search

USPC ..... 81/20, 177.5, 439, 489; 7/143; D8/26, D8/81; 29/566.4

See application file for complete search history.

(56) References Cited

U.S. PATENT DOCUMENTS

| | | | | |
|---|---|---|---|---|
| 1,297,386 | A * | 3/1919 | Michki | 81/25 |
| D263,789 | S * | 4/1982 | Hatchell | D8/26 |
| 4,926,721 | A * | 5/1990 | Hsiao | 81/177.4 |
| 6,279,434 | B1 * | 8/2001 | Brown | 81/437 |
| 6,449,789 | B1 * | 9/2002 | Krass et al. | 7/143 |
| 6,922,864 | B2 * | 8/2005 | Clarke et al. | 7/143 |
| 6,928,899 | B1 * | 8/2005 | Lin | 81/25 |
| 2003/0041384 | A1 * | 3/2003 | Liou | 7/143 |
| 2010/0306990 | A1 * | 12/2010 | Vogel et al. | 29/566.4 |
| 2011/0088519 | A1 * | 4/2011 | Hu | 81/63.1 |

* cited by examiner

*Primary Examiner* — David B Thomas

(74) *Attorney, Agent, or Firm* — Muncy, Geissler, Olds & Lowe, PLLC

(57) ABSTRACT

A multifunctional hand tool includes a first vertical handle and a second handle transversely connected with an upper end of the first handle. A sleeve extends from a lower end of the first handle for inserting various screwdriver bits therein. The second handle has a long grip section and a short grip section at two ends. A hammering body is disposed on an end face of the long grip section. A fitting member is disposed on an end face of the short grip section for inserting various tool accessories therein. The multifunctional hand tool can be conveniently used as various tools with different functions.

3 Claims, 6 Drawing Sheets

MULTIFUNCTIONAL HAND TOOL

BACKGROUND OF THE INVENTION

1. Field of the Invention

The present invention relates generally to a hand tool, and more particularly to a multifunctional hand tool, which can be conveniently used as various tools with different functions.

2. Description of the Related Art

There are various conventional hand tools such as screwdriver, hammer, wrench, etc. Each of these hand tools only has one single function. Therefore, when a user needs to perform different operations, the user must prepare various hand tools at hand. It is quite troublesome to carry a number of hand tools, which have a considerable total weight. Moreover, when storing these hand tools, much room is occupied.

SUMMARY OF THE INVENTION

It is therefore a primary object of the present invention to provide a multifunctional hand tool, which can be conveniently used as various tools with different functions.

To achieve the above and other objects, the multifunctional hand tool of the present invention includes a first vertical handle and a second handle transversely connected with an upper end of the first handle. A sleeve extends from a lower end of the first handle for inserting various screwdriver bits therein. The second handle has a long grip section and a short grip section at two ends. A hammering body is disposed on an end face of the long grip section. A fitting member is disposed on an end face of the short grip section for inserting various tool accessories therein. The multifunctional hand tool can be conveniently used as various tools with different functions.

The multifunctional hand tool of the present invention is advantageous in that the sleeve, the hammering body and the fitting member can be co-used with various tool accessories to provide different modes of use. Accordingly, the same single hand tool can be used as various hand tools to achieve different functions.

The present invention can be best understood through the following description and accompanying drawings, wherein:

DETAILED DESCRIPTION OF THE PREFERRED EMBODIMENT

Figure 1:
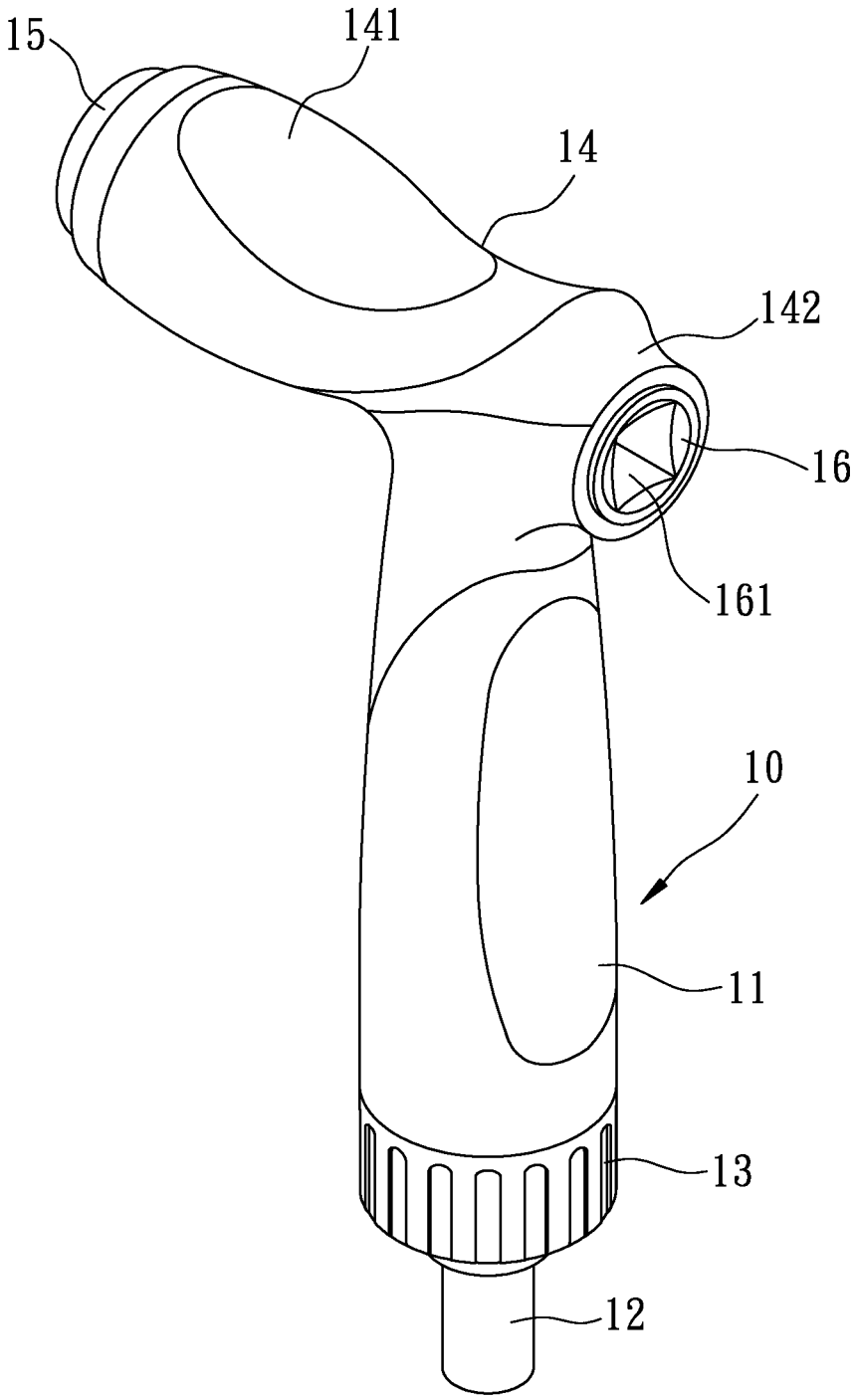
FIG. 1 is a perspective view of a preferred embodiment of the multifunctional hand tool of the present invention.
Figure 2:
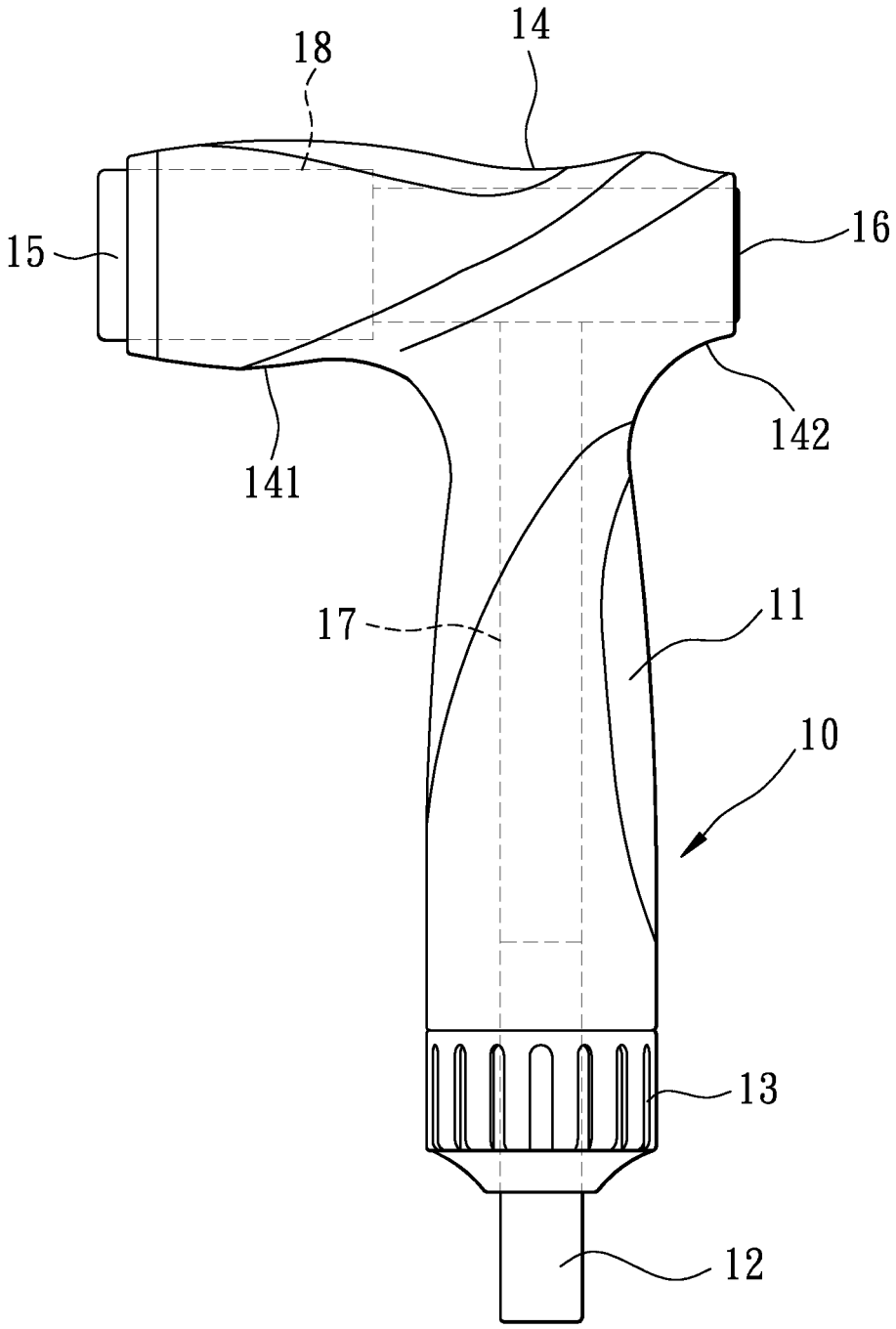
FIG. 2 is a plane view of the preferred embodiment of the multifunctional hand tool of the present invention.

Please refer to FIG. 1. According to a preferred embodiment, the multifunctional hand tool 10 of the present invention is substantially reverse L-shaped. The multifunctional hand tool 10 includes a first vertical handle 11 and a second handle 14 transversely connected with an upper end of the first handle 11. A sleeve 12 extends from a lower end of the first handle 11. Different shapes and sizes of screwdriver bits can be inserted and mounted in the sleeve 12. A ratchet wheel 13 is disposed around the lower end of the first handle 11. The ratchet wheel 13 has an internal ratchet mechanism for controlling the rotational direction of the sleeve 12. The ratchet mechanism pertains to prior art and thus will not be further described hereinafter. The second handle 14 has a long grip section 141 and a short grip section 142 at two ends. A hammering body 15 is disposed on an end face of the long grip section 141. A fitting member 16 is disposed on an end face of the short grip section 142. In this embodiment, the fitting member 16 is recessed to form a rectangular hole 161 for inserting various tool accessories therein. The long and short grip sections 141, 142 are respectively disposed at two ends of the second handle 14 and have different lengths. This is mainly for solving the problem of counterbalance of applied force. In case that the two ends of the second handle 14 have equal lengths, a user can hardly effectively hammer a work piece with the hammering body 15. Further referring to FIG. 2, the sleeve 12 has a first vertical shank section 17 embedded in the first handle 11 and extending into the interior of the first handle 11. The hammering body 15 and the fitting member 16 have a second transverse shank section 18 embedded in the second handle 14 and extending into the interior of the second handle 14. An upper end of the first shank section 17 is integrally connected with the second shank section 18 so as to increase structural strength of the hammering body 15, the fitting member 16 and the sleeve 12.

Figure 3:
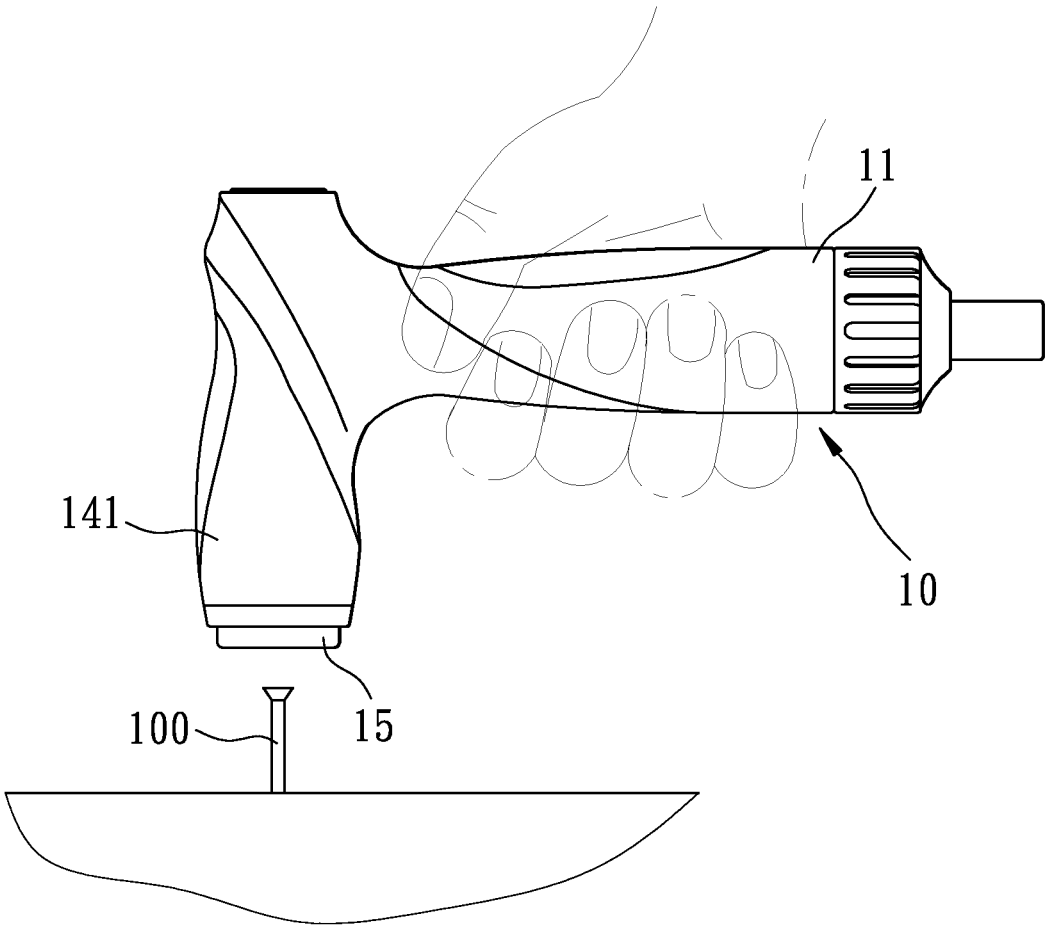
FIG. 3 is a view showing the use of the preferred embodiment of the multifunctional hand tool of the present invention, in which the multifunctional hand tool is used to hammer a nail as a hammer.

The multifunctional hand tool of the present invention is operated to achieve the functions as follows:

First, as shown in FIG. 3, a user can hold the first handle section 11 with one hand with the long grip section 141 directed downward. Then the user can use the hammering body 15 to hammer a nail 100.

Figure 4:
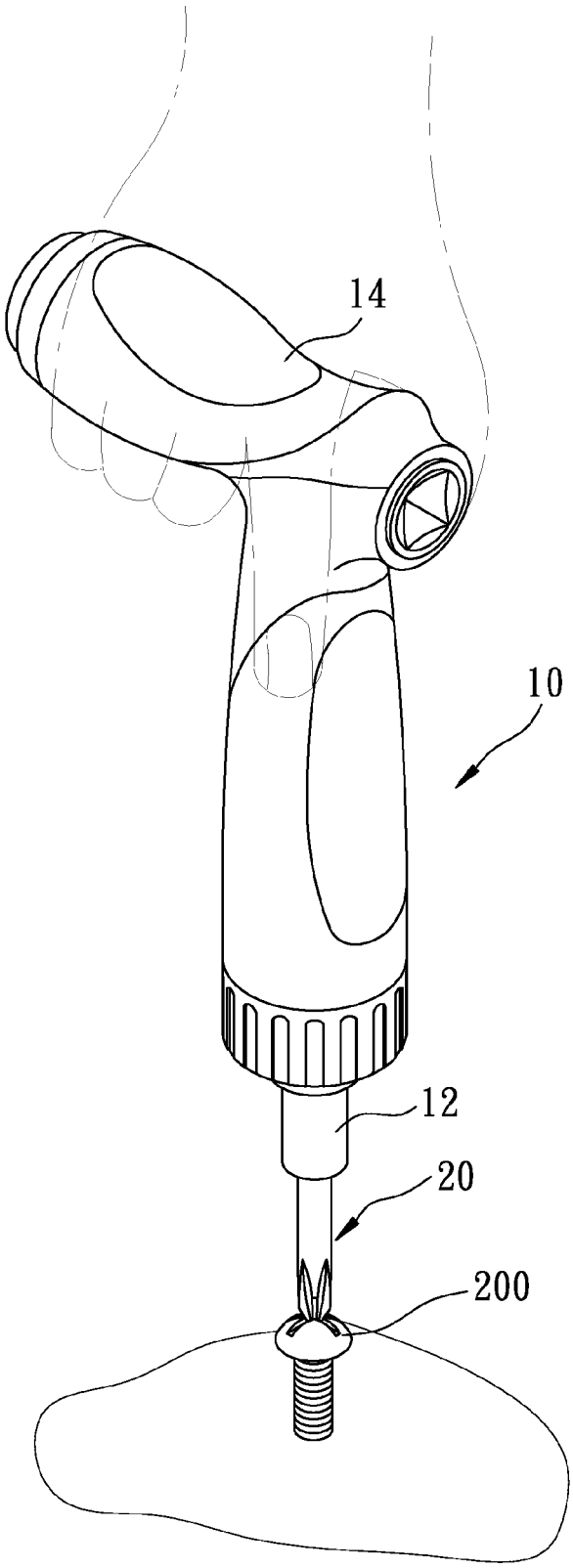
FIG. 4 is a perspective view showing the use of the preferred embodiment of the multifunctional hand tool of the present invention, in which the multifunctional hand tool is used to screw/unscrew a screw as a screwdriver.

Second, as shown in FIG. 4, a user can hold the second handle 14 with one hand and mount a predetermined size of screwdriver bit 20 into the sleeve 12. In this case, the user can screw/unscrew a screw 200 with the hand tool 10.

Figure 5:
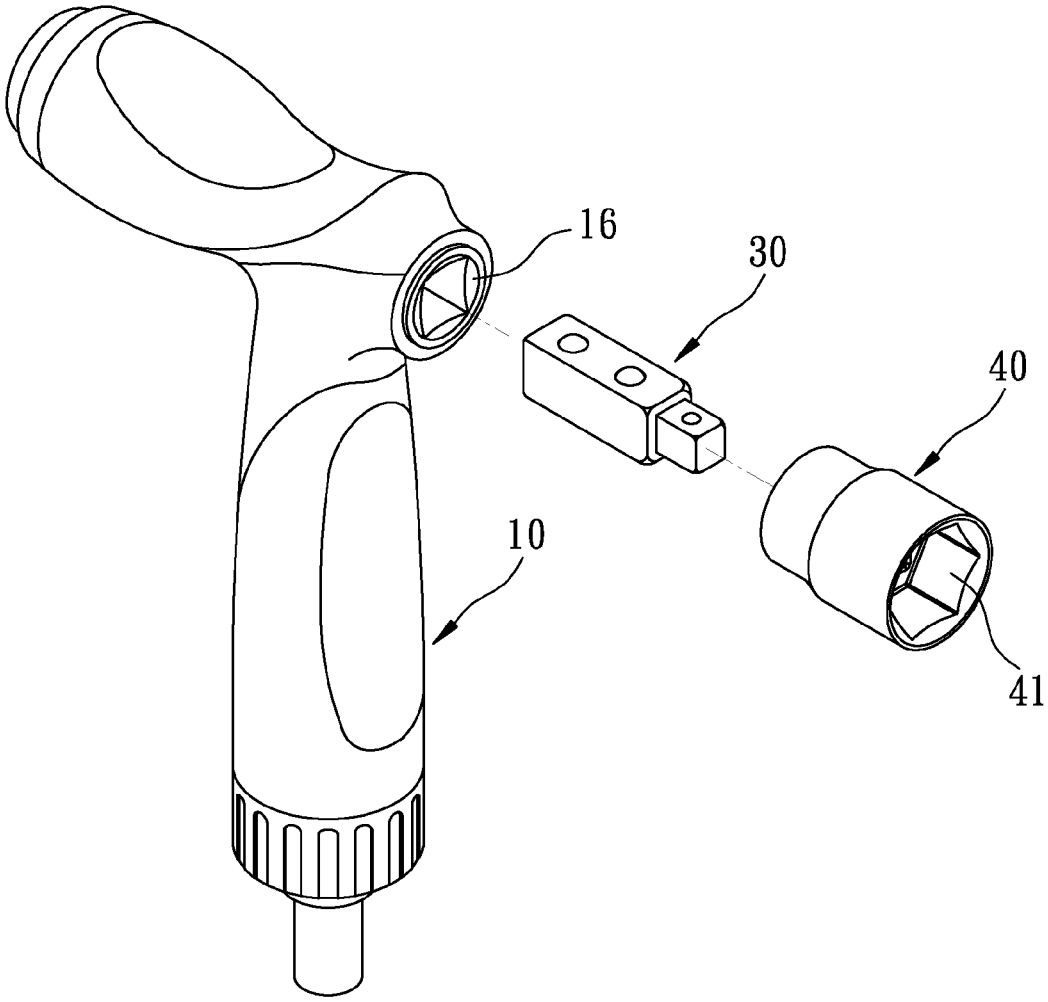
FIG. 5 is a perspective exploded view showing the use of the preferred embodiment of the multifunctional hand tool of the present invention, in which a socket is fitted with the present invention to form a socket wrench.

Third, as shown in FIG. 5, an adapter 30 can be fitted into the fitting member 16 of the hand tool 10 and then a socket 40 can be further fitted with an outer end of the adapter 30. The socket 40 is formed with an internal hexagonal hole 41 with a predetermined size. Accordingly, the user can use the hand tool 10 to wrench a hexagonal nut as a socket wrench.

Figure 6:
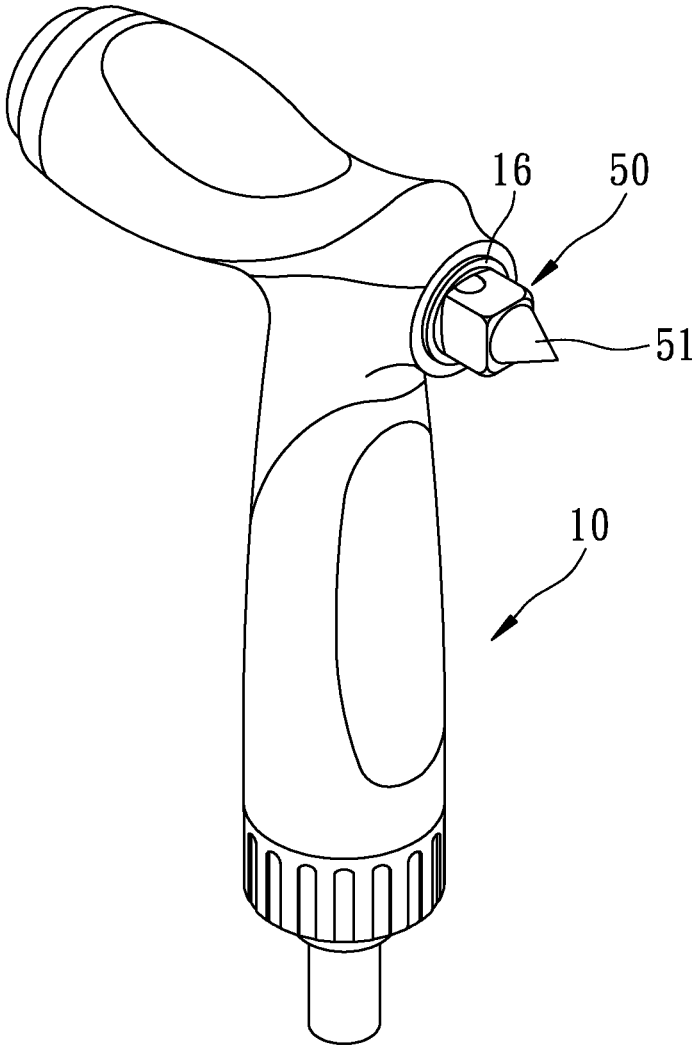
FIG. 6 is a perspective view showing the use of the preferred embodiment of the multifunctional hand tool of the present invention, in which a chisel is fitted with the present invention.

Fourth, as shown in FIG. 6, a chisel 50 can be mounted into the fitting member 16 of the hand tool 10. The chisel 50 has a conic tip section 51 at outer end. In this case, the hand tool 10 can be used as a tool for breaking a piece of glass.

In conclusion, the multifunctional hand tool 10 of the present invention overcomes the shortcoming existing in the conventional tool that only has one single function. The multifunctional hand tool 10 of the present invention is characterized in that the hand tool 10 has a first handle 11 and a second handle 14. The sleeve 12 is disposed at the lower end of the first handle 11 for inserting a screwdriver bit 20 therein. The hammering body 15 and the fitting member 16 are respectively disposed at two ends of the second handle 14. Various tool accessories can be inserted in the fitting member 16. Accordingly, the same hand tool 10 of the present invention can be used as a screwdriver, a wrench, a hammer, etc. to provide multiple functions. The hand tool 10 of the present invention can be very conveniently used. Moreover, the hand tool 10 of the present invention has small volume and is lightweight for easy carriage. Also, the hand tool 10 of the present invention can be easily stored without occupying much room.

The above embodiment is only used to illustrate the present invention, not intended to limit the scope thereof. Many modifications of the above embodiment can be made without departing from the spirit of the present invention.

What is claimed is:

1. A multifunctional hand tool comprising a first vertical handle and a second handle transversely connected with an upper end of the first handle, a sleeve extending from a lower end of the first handle for inserting various screwdriver bits therein, the second handle having a long grip section and a short grip section at two ends, a hammering body being disposed on an end face of the long grip section, a fitting member being disposed on an end face of the short grip section for inserting various tool accessories therein.

2. The multifunctional hand tool as claimed in claim 1, wherein the sleeve has a first vertical shank section embedded in the first handle and extending into the interior of the first handle, the hammering body and the fitting member having a second transverse shank section embedded in the second handle and extending into the interior of the second handle, the first shank section being integrally connected with the second shank section.

3. The multifunctional hand tool as claimed in claim 1, wherein a ratchet wheel is disposed at the lower end of the first handle for controlling rotational direction of the sleeve.

* * * * *